US011013347B1

(12) United States Patent
Sawick

(10) Patent No.: US 11,013,347 B1
(45) Date of Patent: May 25, 2021

(54) ARM ATTACHED BABY FEEDING PILLOW

(71) Applicant: Jill Sawick, Avondale, AZ (US)

(72) Inventor: Jill Sawick, Avondale, AZ (US)

( * ) Notice: Subject to any disclaimer, the term of this patent is extended or adjusted under 35 U.S.C. 154(b) by 0 days.

(21) Appl. No.: 16/655,856

(22) Filed: Oct. 17, 2019

(51) Int. Cl.
*A47D 13/08* (2006.01)
*A47D 15/00* (2006.01)
*A47G 9/02* (2006.01)

(52) U.S. Cl.
CPC ..... *A47D 13/083* (2013.01); *A47D 15/00* (2013.01); *A47G 9/0223* (2013.01)

(58) Field of Classification Search
CPC ..... A47D 13/08; A47D 13/083; A47D 15/00; A47G 9/0223; A47G 9/02
See application file for complete search history.

(56) References Cited

U.S. PATENT DOCUMENTS 5,159,727 A * 11/1992 McCracken ..... A47D 13/083 5/482
6,427,265 B1 * 8/2002 Dix ..... A47D 15/00 5/482
7,131,156 B1 * 11/2006 Walker-Craft ..... A47G 9/1045 5/655

* cited by examiner

*Primary Examiner* — Fredrick C Conley
(74) *Attorney, Agent, or Firm* — Sanchelima & Associates, P.A.; Christian Sanchelima; Alexander Rodriguez

(57) ABSTRACT

An arm attached baby feeding pillow including a cushion assembly and a blanket assembly is disclosed herein. The cushion assembly includes a hollow cushion having an inner portion and an outer portion. The inner portion includes padding thereon and the outer portion includes a pillow. A user may insert their forearm into the hollow cushion to secure the arm attached baby feeding pillow to their body. Additionally, a baby's head is configured to rest comfortably on the pillow provided on the outer portion of the hollow cushion. Furthermore, the blanket assembly includes a blanket having four perimeter sides wherein the cushion assembly is attached to the blanket using hook and loop fasteners. The blanket additionally includes cloth loops to hold toys for a baby. A storage compartment is also provided to hold a bottle when feeding a baby.

11 Claims, 4 Drawing Sheets

ARM ATTACHED BABY FEEDING PILLOW

BACKGROUND OF THE INVENTION

1. Field of the Invention

The present invention relates to an arm attached baby feeding pillow and, more particularly, to an arm attached baby feeding pillow that provides a comfortable way to hold and feed a baby with entertainment for the baby while simultaneously shielding an adult from baby fluids.

2. Description of the Related Art

Several designs for a pillow have been designed in the past. None of them, however, include a forearm-attached cylindrical cushion with an attached blanket. The cylindrical cushion comprises a padded hollow cushion in which an arm is inserted and is used to support and comfort a baby being held in the arms of a user. The attached blanket can be draped over a person's lap or wrapped around a baby. It is known that individuals with infants often have a need to find a comfortable position to feed a baby. It is also known that in the process of feeding a baby there may be unintentional spills and messes when feeding the baby. Therefore, there is a need for a device that provides an effective method for comfortable feeding a baby that provides protection against unavoidable spills and messes. Additionally, there is a need for such a device that securely attaches to a user's arm and provides suitable protection to a baby's head.

Applicant believes that a related reference corresponds to U.S. patent (published application) No. U.S. Pat. No. 7,131,156B1 issued for a multipurpose pillow that includes a tubular body formed with a substantially soft and resilient material between a fabric enclosure. The tubular body has a central channel for receiving a caregiver's arm. The tubular body has a pocket and a cover interconnected to the tubular body. Additionally, the cover is sized to extend from the tubular body and operate as a blanket. Furthermore, the cover is sized to fit inside the pocket of the tubular body when not being used. However, it differs from the present invention because the U.S. Pat. No. 7,131,156B1 reference fails to address the issue of providing a cushion assembly that is provided as an integral part of a blanket. Additionally, the reference fails to address the problem of providing a comfortable method of feeding a baby while resting on a caregiver's lap. The present invention addresses these issues by providing a cushion assembly that is an integral part of a blanket assembly. Additionally, the present invention aids a user in feeding a baby that is resting on a caregiver's lap. Furthermore, the present invention includes cloth loops that hold the toys of a baby and a storage compartment configured to hold a bottle for feeding a baby.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an arm attached baby feeding pillow that gives a user a more effective method for a parent to hold and feed a baby.

It is another object of this invention to provide an arm attached baby feeding pillow that helps to support a baby's head and neck while simultaneously enhancing the comfort and warmth of the baby.

It is still another object of the present invention to provide an arm attached baby feeding pillow that includes added protection against spills and other messes that may result when feeding a baby.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
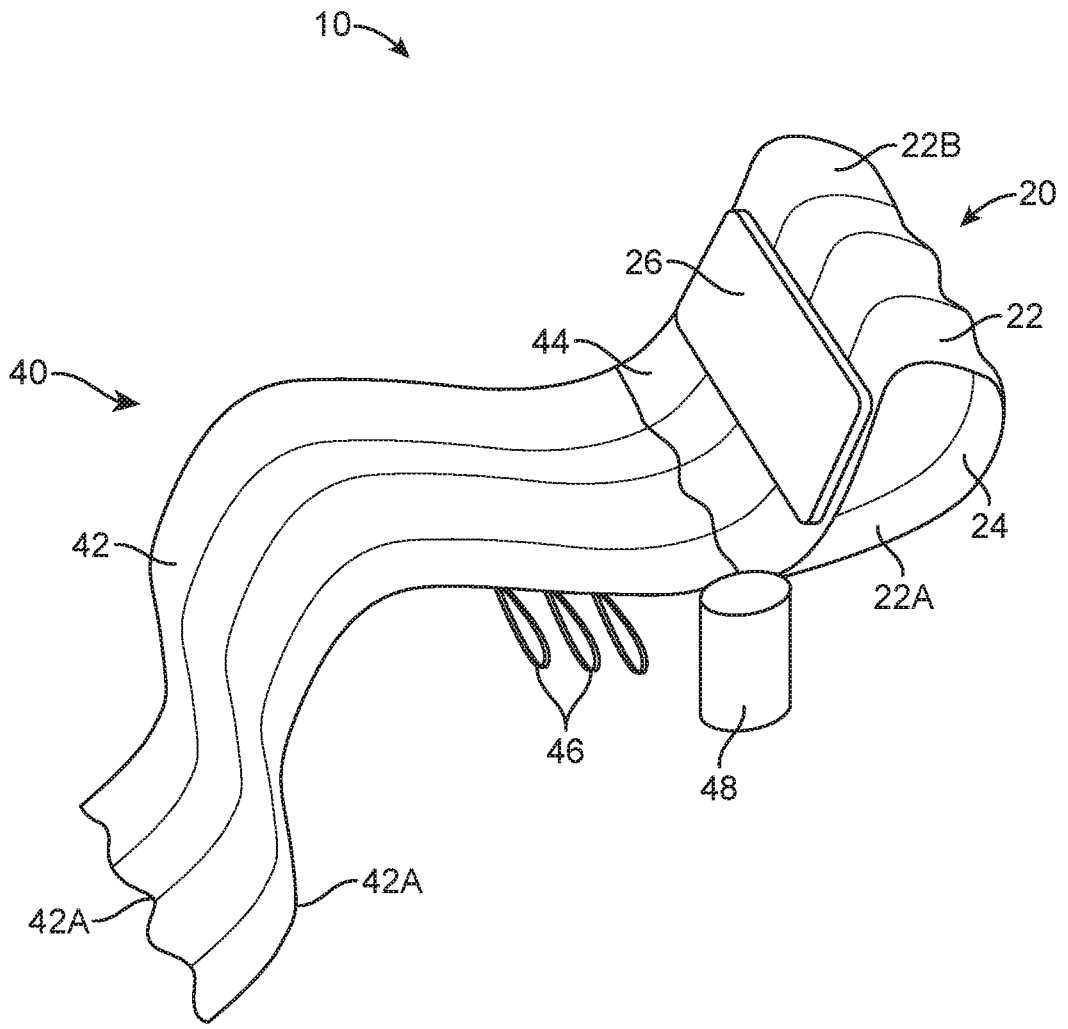
FIG. 1 represents an isometric view of an arm attached baby feeding pillow 10 wherein a cushion assembly 20 and a blanket assembly 40 may be observed in accordance to an embodiment of the present invention.
Figure 2:
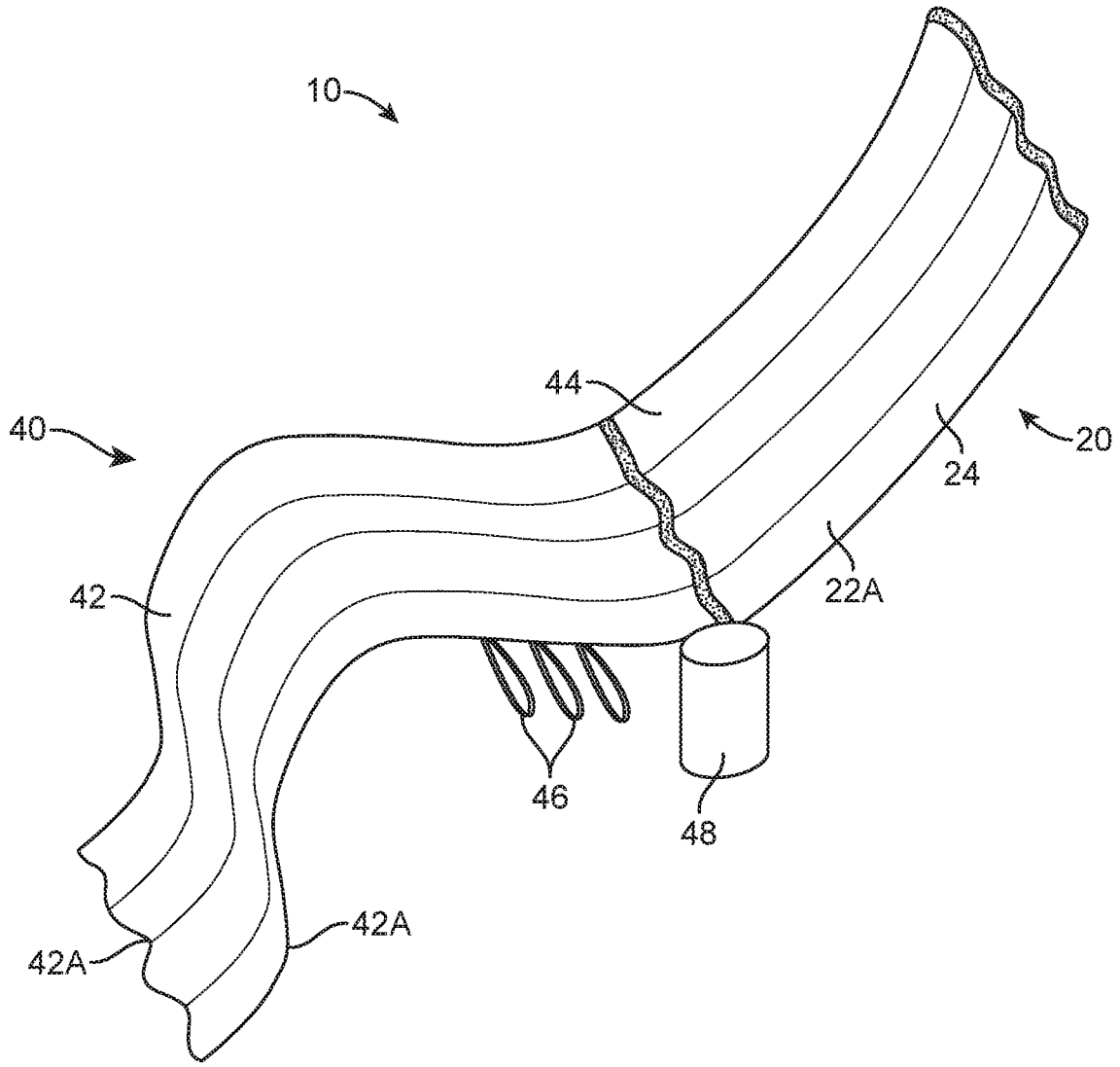
FIG. 2 illustrates another isometric view of an arm attached baby feeding pillow 10 having a section of cushion assembly 20 detached from blanket assembly 40 in accordance to an embodiment of the present invention.
Figure 3:
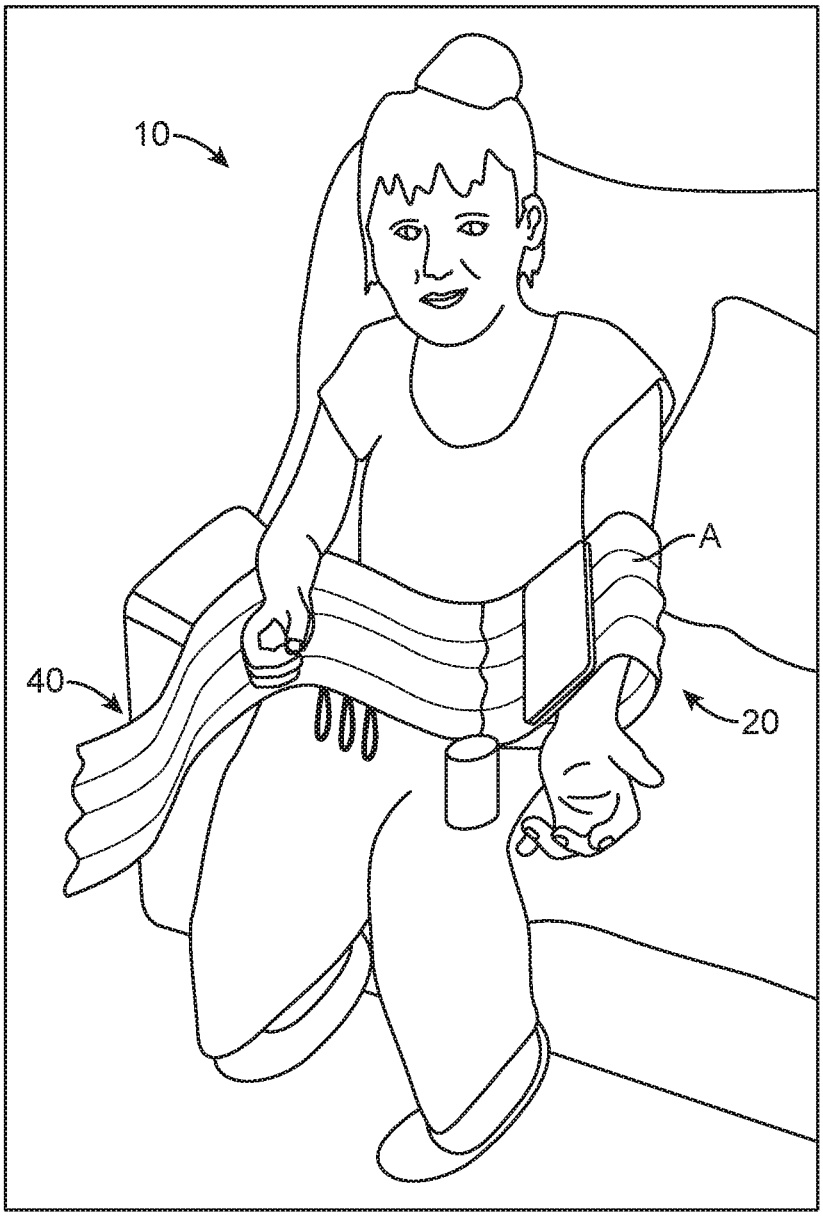
FIG. 3 shows another isometric view of an arm attached baby feeding pillow 10 in use, wherein a user may be observed having arm attached baby feeding pillow 10 attached to their forearm A.
Figure 4:
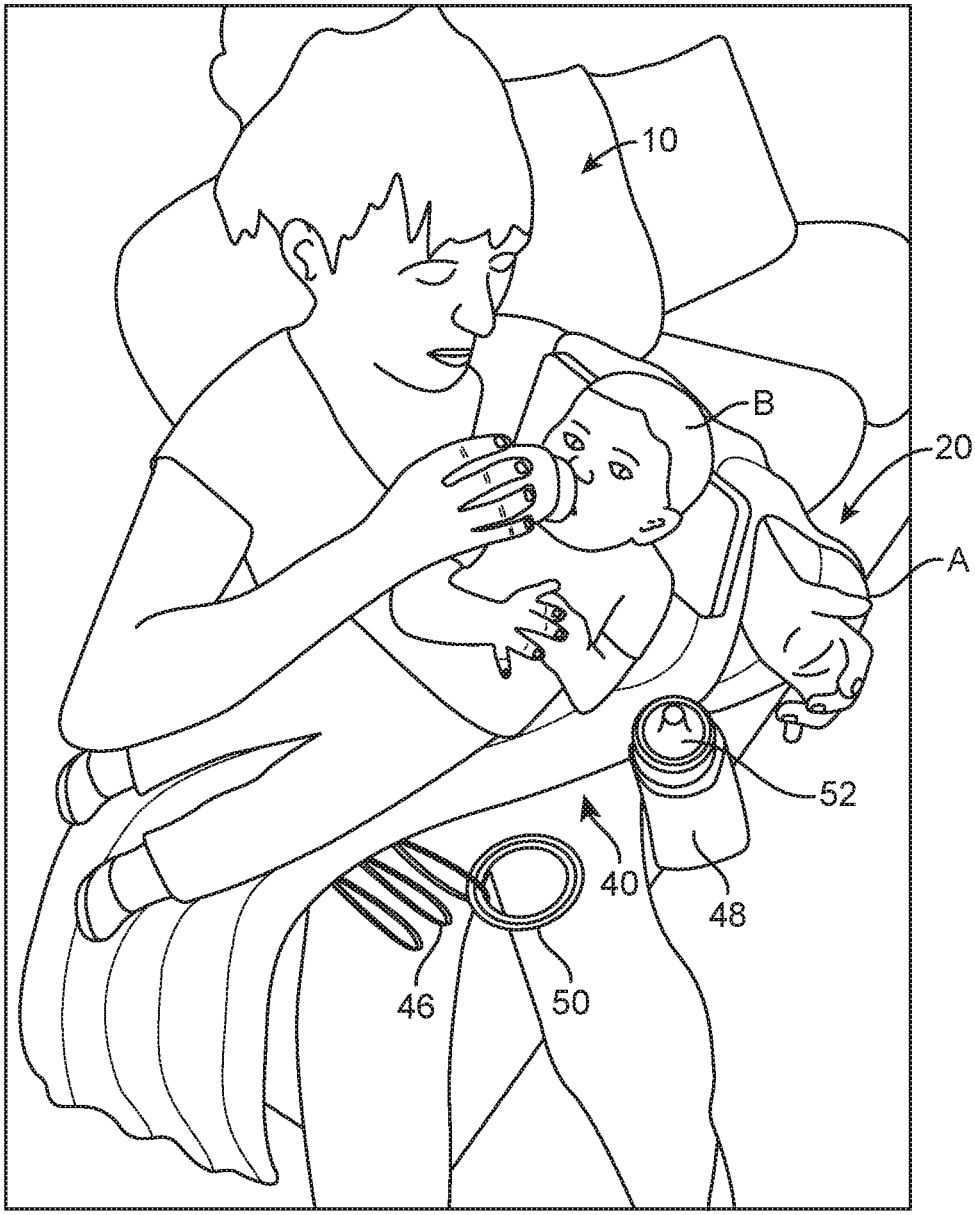
FIG. 4 illustrates another isometric view of an arm attached baby feeding pillow 10 in use, wherein toys 30 and bottle 32 may be seen attached thereon, as well as a baby B may be seen resting on a user's lap having arm attached baby feeding pillow 10.

Referring now to the drawings, where the present invention is generally referred to with numeral 10, it can be observed an arm attached baby feeding pillow 10 that basically includes a cushion assembly 20 and a blanket assembly 40.

Cushion assembly 20 includes a hollow cushion 22 having an inner portion 22A and an outer portion 22B. Hollow cushion 22 may be made of a suitable material configured to be comfortable to a user and a baby. These materials may include but not limited to cloth, silk, cotton, and the like. In the present embodiment, hollow cushion 22 is provided in a cylindrical shape. Additionally, a user inserts their forearm A into hollow cushion 22 to secure hollow cushion 22 to a user's body. Inner portion 22A includes padding 24 therein. Padding 24 may be of any suitable padding material configured to be comfortable for a user therein. In the present embodiment, padding 24 extends along the entire surface area of inner portion 22A. In an embodiment of the present invention, outer portion 22B includes a pillow 26 disposed thereon. Pillow 26 may be provided as an integral part of hollow cushion 22 or may be provided as a removable attachment to hollow cushion 22. In an embodiment of the present invention, pillow 26 may be provided in a rectangular configuration. However, it should be understood that any suitable shape may be used for pillow 26.

Blanket assembly 40 includes a blanket 42 having four perimeter sides 42A. In one embodiment of the present invention, blanket 42 is made of a suitable material that is comfortable to a user and to a baby. This may include materials such as but not limited to cloth, silk, cotton, and the like. In additional embodiments other materials or a combination thereof may be used. Blanket 42 includes hook and loop fasteners 44 disposed on a perimeter side. Hook and loop fasteners 44 allow hollow cushion 22 to be securely mounted to blanket 42. Additionally, hook and loop fasteners 44 allow cushion assembly 20 to be detached form blanket 42. As a result, one complete flat blanket may be formed. Blanket 42 additionally includes cloth loops 46 disposed thereon. Cloth loops 46 may be provided as an integral part of blanket 42 and made of the same material as blanket 42. Furthermore, cloth loops 46 may be used to hold toys 50 thereon to aid a user when feeding a baby. A user may store toys 50 within cloth loops 46 and remove toys 50 when needed to entertain a baby. Additionally, blanket 42 includes a storage compartment 48 provided on a perimeter side of blanket 42. Storage compartment 48 may be provided as a cylindrical storage container that is an integral part of blanket 42. A user may then place a bottle 52 within storage compartment 48 to provide an easy means of storage for a bottle being used to feed a baby. In an embodiment of the present invention, a user attaches cushion assembly 20 to their forearm A. A user then rests arm attached baby feeding pillow 10 onto their lap. A baby B is then placed on the user's lap to aid the user in feeding baby B. The present invention 10, is travel friendly, washable, and can come in various patterns. Additionally, teething devices and toys may be added to aid the enjoyment of a baby. Furthermore, the present invention 10 may be compatible with other baby toys that utilize the cloth loops to be attached and hanged thereon.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a baby feeding pillow, comprising:

a. a cushion assembly, including a hollow cushion having an inner portion and an outer portion, wherein said outer portion includes padding therein, and said outer portion further includes a pillow being rectangular in shape and extending about an entire width of said outer portion, said pillow is an integral part of said hollow cushion, wherein said cushion assembly is configured to be removably mounted to a user's forearm; and b. a blanket assembly, including a blanket having four perimeter sides, wherein a side of said blanket includes hook and loop fasteners configured to secure said hollow cushion to said blanket, wherein said blanket includes a top surface and a bottom surface, wherein said top surface includes a top most edge being lined with said hook and loop fasteners, wherein said hook and loop fasteners extend about the entirety of said top most edge, wherein said top surface of said blanket further includes a middle portion having said hook and loop fasteners lined across an entire width of said middle portion, wherein said hook and loop fasteners of said top most end and said hook and loop fasteners of the middle portion are engaged to form said hollow cushion, wherein the formation of said hollow cushion leaves a blanket portion extending from said hollow cushion when formed, wherein said blanket further includes cloth loops thereon, said blanket further including a storage compartment, wherein said storage compartment is in abutting engagement with a perimeter side of said blanket, wherein said storage compartment is located along said middle portion of said blanket, wherein said cushion assembly is an integral part of said blanket assembly.

2. The system for an arm attached baby feeding pillow of claim 1 wherein said blanket assembly is rectangular in shape.

3. The system for an arm attached baby feeding pillow of claim 1 wherein said hollow cushion is cylindrical in shape.

4. The system for an arm attached baby feeding pillow of claim 1 wherein said cloth loops hold toys for a user feeding the baby.

5. The system for an arm attached baby feeding pillow of claim 1 wherein said storage compartment holds a bottle for a user feeding the baby.

6. The system for an arm attached baby feeding pillow of claim 1 wherein a user inserts their forearm into the hollow cushion to secure said hollow cushion to their arm.

7. The system for an arm attached baby feeding pillow of claim 1 wherein the baby rests on said blanket and the baby's head rests on said pillow.

8. The system for an arm attached baby feeding pillow of claim 1 wherein said storage compartment is of a hollow cylindrical shape that cooperates with a bottle.

9. The system for an arm attached baby feeding pillow of claim 1 wherein said blanket is draped over a user's lap or is wrapped around the baby.

10. A system for a baby feeding pillow, consisting of:

a. a cushion assembly, including a hollow cushion being cylindrical in shape having an inner portion and an outer portion, wherein said outer portion includes padding therein, wherein said outer portion includes a pillow being rectangular in shape located thereon, said pillow extending about an entire width of said outer portion, wherein said pillow is an integral part of said hollow cushion, wherein said cushion assembly is configured to be removably mounted to a user's forearm, wherein said user rests the baby's head onto said pillow of said hollow cushion, wherein said hollow cushion is configured to support and comfort the baby being held in the arms of a user; and b. a blanket assembly, including a blanket having four perimeter sides, wherein a side of said blanket includes hook and loop fasteners configured to secure said hollow cushion to said blanket, wherein said blanket includes a top surface and a bottom surface, wherein said top surface includes a top most edge being lined with said hook and loop fasteners, wherein said hook and loop fasteners extend about the entirety of said top most edge, wherein said top surface of said blanket further includes a middle portion having said hook and loop fasteners lined across an entire width of said middle portion, wherein said hook and loop fasteners of said top most end and said hook and loop fasteners of the middle portion are engaged to form said hollow cushion, wherein the formation of said hollow cushion leaves a blanket portion extending from said hollow cushion when formed, wherein said blanket further includes cloth loops thereon, wherein said loops hold toys therein to entertain the baby while a user feeds the baby, wherein said blanket further includes a storage compartment being cylindrical in shape, wherein said storage compartment holds a bottle used in feeding the baby, wherein said cloth loops and said storage compartment are on the same perimeter side of said blanket, wherein said cushion assembly is an integral part of said blanket assembly.

11. A system for a baby feeding pillow, consisting of:

a. a blanket assembly including a blanket having four perimeter sides, wherein said blanket having a rectangular shape with a length being greater than a width, wherein said blanket includes a top surface and a bottom surface, wherein a topmost end of the top surface of said blanket is lined with hook and loop fasteners, said hook and loop fasteners extending across an entire width of said topmost end, wherein said top surface further includes a middle portion being lined with hook and loop fasteners across an entire width of said middle portion, wherein a perimeter side of said four perimeter sides includes three cloth loops adjacently positioned with respect to each other, wherein one of said three cloth loops includes a circular toy mounted thereon, wherein said perimeter side further includes a hollow cylindrical compartment that is abutting with said perimeter side along the middle portion of said blanket, wherein said hollow cylindrical compartment contains a bottle therein;

b. a cushion assembly formed when said hook and loop fasteners of said topmost end and said hook and loop fasteners of said middle portion are engaged to form a hollow cushion with an inner portion and an outer portion, wherein said inner portion is adapted to receive a user's arm therein, wherein an outer portion of said hollow cushion includes a rectangular pillow pad which extends about an entire width of said outer portion.

* * * * *